US010239327B2

(12) United States Patent
Gracia Verdugo et al.

(10) Patent No.: US 10,239,327 B2
(45) Date of Patent: Mar. 26, 2019

(54) METHOD OF PRINTING AND PRINTER

(71) Applicant: HEWLETT-PACKARD DEVELOPMENT COMPANY, L.P., Houston, TX (US)

(72) Inventors: Antonio Gracia Verdugo, Barcelona (ES); Marina Cantero Lazaro, Barcelona (ES); Mauricio Seras, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/329,956

(22) PCT Filed: Jul. 31, 2014

(86) PCT No.: PCT/EP2014/066457
§ 371 (c)(1),
(2) Date: Jan. 27, 2017

(87) PCT Pub. No.: WO2016/015766
PCT Pub. Date: Feb. 4, 2016

(65) Prior Publication Data

US 2017/0259582 A1 Sep. 14, 2017

(51) Int. Cl.
*B41J 2/21* (2006.01)
*B41J 2/045* (2006.01)
(Continued)

(52) U.S. Cl.
CPC ..... *B41J 2/2146* (2013.01); *B41J 2/04508* (2013.01); *B41J 2/04543* (2013.01);
(Continued)

(58) Field of Classification Search
CPC .... B41J 2/2146; B41J 2/2103; B41J 2/04508; B41J 2/155; B41J 2/2132; B41J 2/5056; B41J 2/15; B41J 2/04543; G06K 15/102
See application file for complete search history.

(56) References Cited

U.S. PATENT DOCUMENTS 5,500,661 A 3/1996 Matsubara et al.
5,610,634 A 3/1997 Murata et al.
(Continued)

FOREIGN PATENT DOCUMENTS

EP 1473662 11/2014
TW 201008789 A 3/2010

OTHER PUBLICATIONS

William, B.J. et al, Effect of Print Masks on the Functional Performance of Inkjet Printed Pd Hexadecanethiolate in Toluene, (Research Paper), Jan. 1, 2013.

*Primary Examiner* — Geoffrey S Mruk
(74) *Attorney, Agent, or Firm* — HP Inc. Patent Department

(57) ABSTRACT

A method of printing a pattern from at least two rows of fluid ejection nozzles, said nozzles ejecting a first fluid in a multi-pass printing mode, the method comprising: dividing the pattern to be printed between the rows of fluid ejection nozzles; applying masks to the rows of fluid ejection nozzles for printing with selected nozzles of each of the rows of fluid ejection nozzles during each pass; wherein a first mask for printing from a first row of fluid ejection nozzles during an n-th pass is different from a second mask for printing from a second row of fluid ejection nozzles during said n-th pass.

14 Claims, 9 Drawing Sheets

(51) Int. Cl.
*B41J 2/15* (2006.01)
*B41J 2/155* (2006.01)
*B41J 2/505* (2006.01)

(52) U.S. Cl.
CPC ..... *B41J 2/15* (2013.01); *B41J 2/155* (2013.01); *B41J 2/2103* (2013.01); *B41J 2/2132* (2013.01); *B41J 2/5056* (2013.01)

(56) References Cited

U.S. PATENT DOCUMENTS 6,254,217 B1 7/2001 Askeland et al.
6,278,469 B1 8/2001 Bland et al.
6,375,307 B1 4/2002 Vinals et al.
6,491,374 B1 12/2002 Bauer et al.
7,261,388 B2 8/2007 Vega et al.
7,472,983 B2 1/2009 Fellingham et al.
8,272,710 B2 9/2012 Spaulding et al.
2001/0012033 A1 8/2001 Ono et al.
2002/0070997 A1* 6/2002 Nakagawa ..... B41J 2/2132 347/37
2004/0095408 A1* 5/2004 Nunokawa ..... B41J 2/2132 347/19
2008/0211870 A1 9/2008 Owaki et al.
2010/0013878 A1 1/2010 Spaulding et al.
2010/0045723 A1* 2/2010 Kato ..... B41J 2/2107 347/15
2010/0182367 A1* 7/2010 Takagi ..... B41J 2/145 347/14
2011/0221814 A1 9/2011 Tamai et al.
2012/0026227 A1* 2/2012 Tanaka ..... B41J 2/2132 347/9
2012/0229549 A1* 9/2012 Shibata ..... B41J 2/04508 347/15
2013/0182042 A1* 7/2013 Uchida ..... B41J 2/145 347/43
2013/0241997 A1 9/2013 Teshigawara et al.
2014/0292843 A1* 10/2014 Fernandez del Rio ..... B41J 2/2114 347/6
2015/0321490 A1* 11/2015 Verdugo ..... B41J 2/21 347/16

* cited by examiner

METHOD OF PRINTING AND PRINTER

BACKGROUND

A color printer may include a number of print heads. A print head may contain one or several dies, wherein each die may be associated with the same or different colors. A die may provide one or more lines or rows of nozzles, also referred to as nozzle trenches. When printing with a number of print heads, using a multiple-pass printing mode, masks may be applied to the nozzles to selectively deposit droplets of printing fluid on a print medium, pass by pass, to control the printing process. Print masks may help to prevent or reduce visible artifacts, such as image banding.

SHORT DESCRIPTION OF DRAWINGS

Examples of this disclosure now are described with reference to the drawings, wherein.

Figure 2:
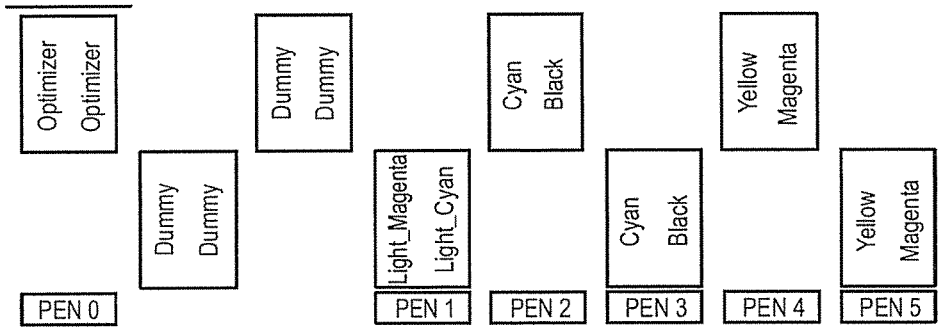
FIG. 2 shows a schematic representation of a print head arrangement in a printer according to one example.
Figure 4:
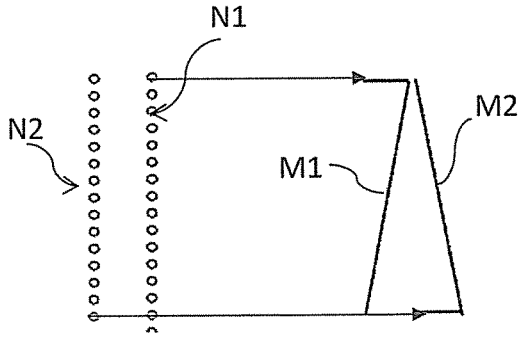
Figure 5:
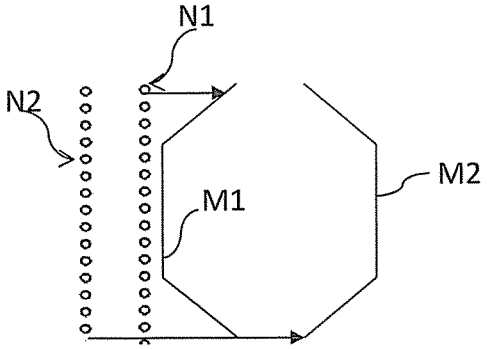
Figure 6:
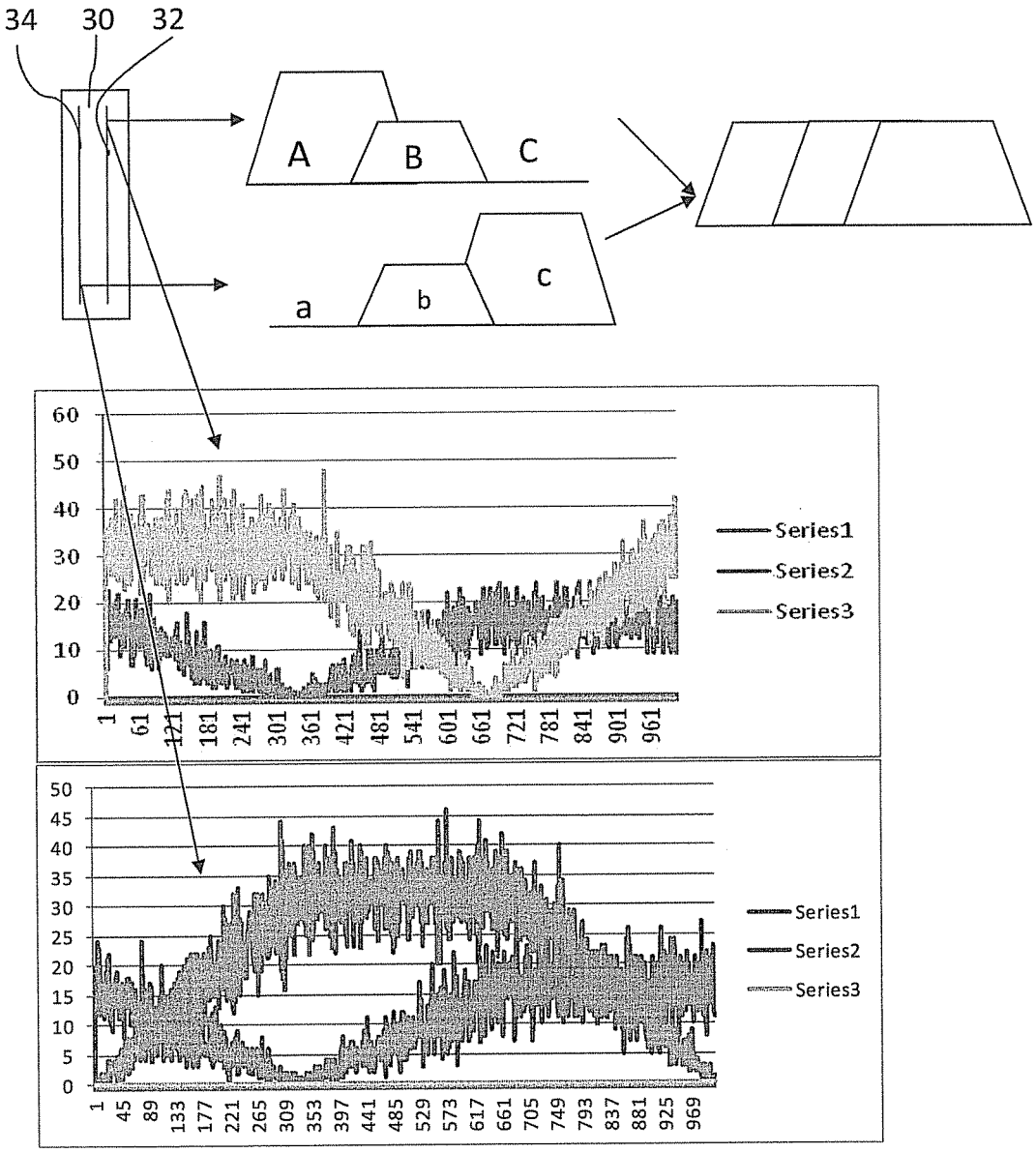
Figure 7:
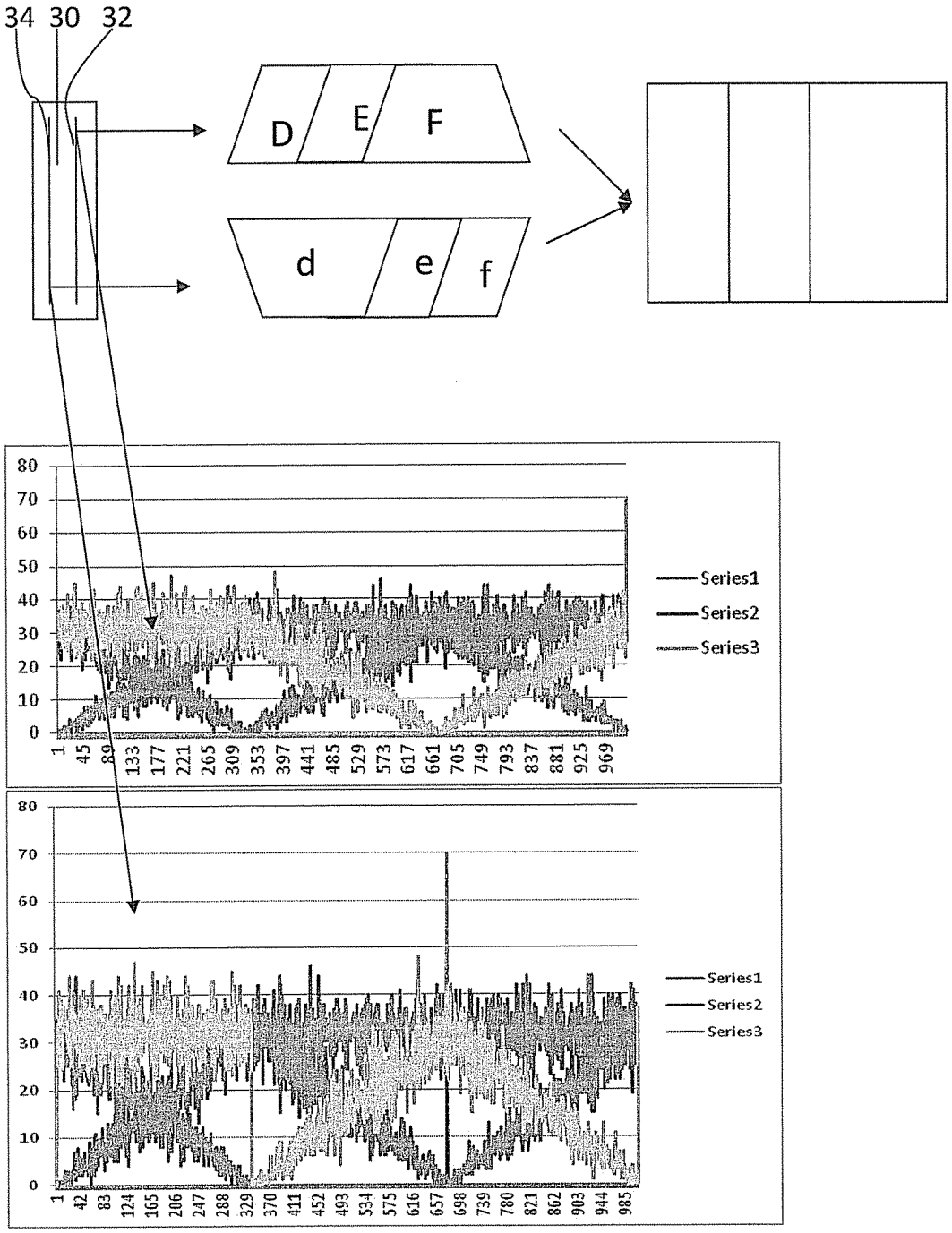
Figure 8:
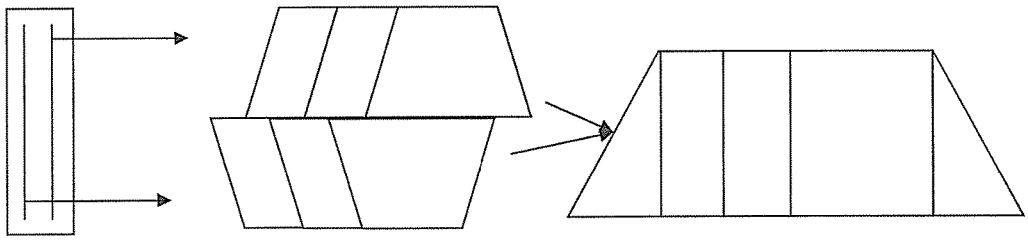
Figure 9:
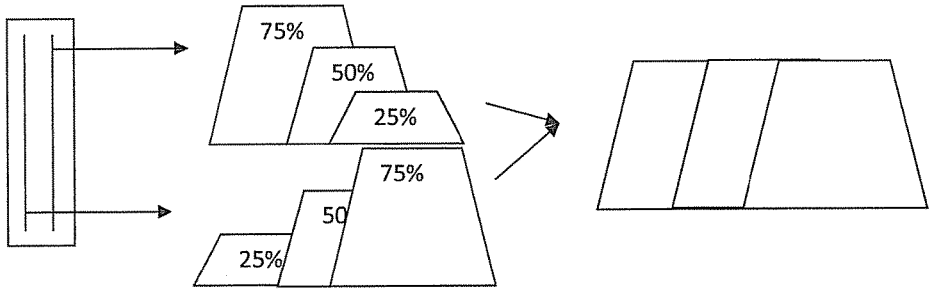
Figure 10:
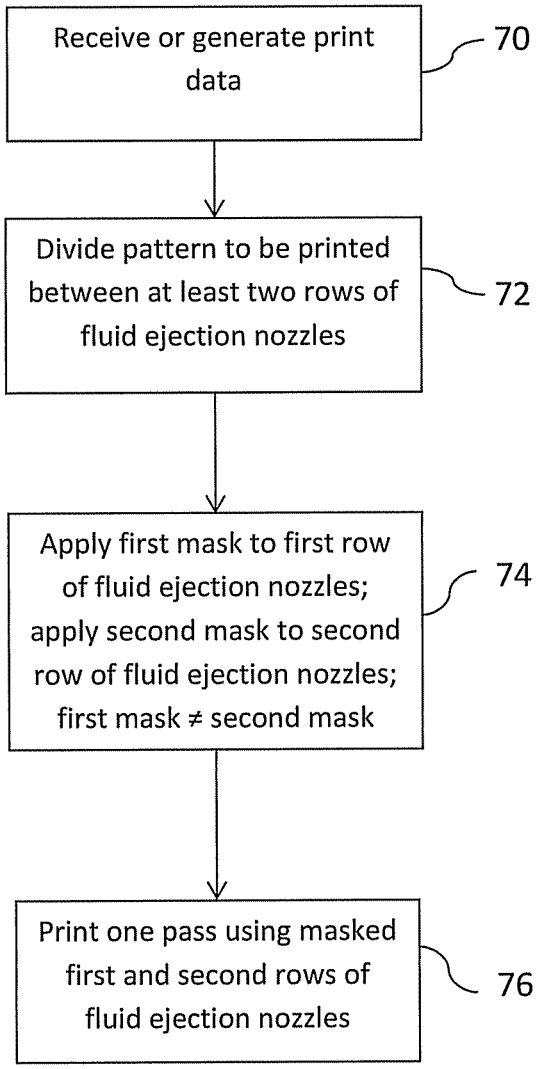
Figure 11:
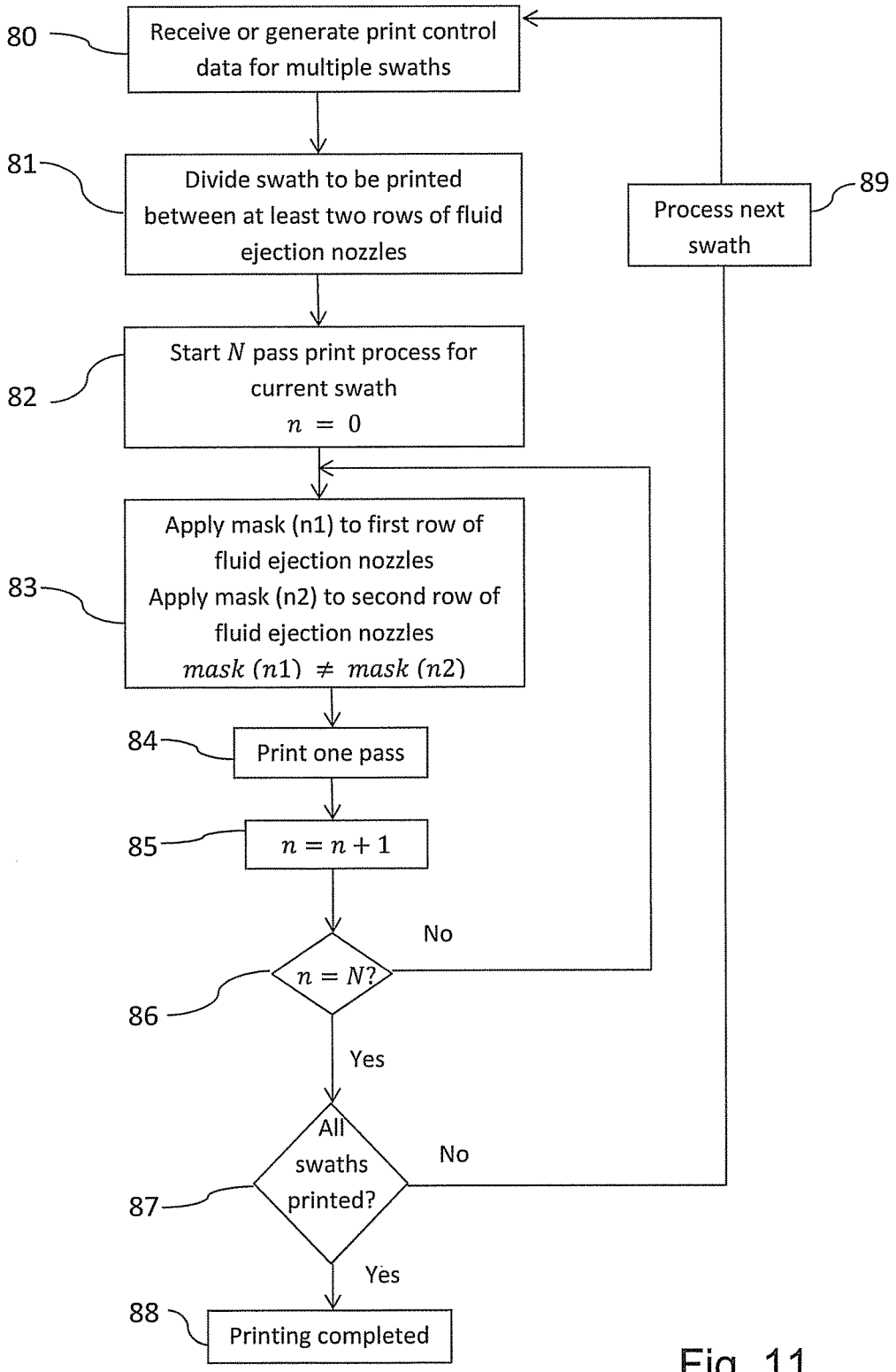
Figure 12:
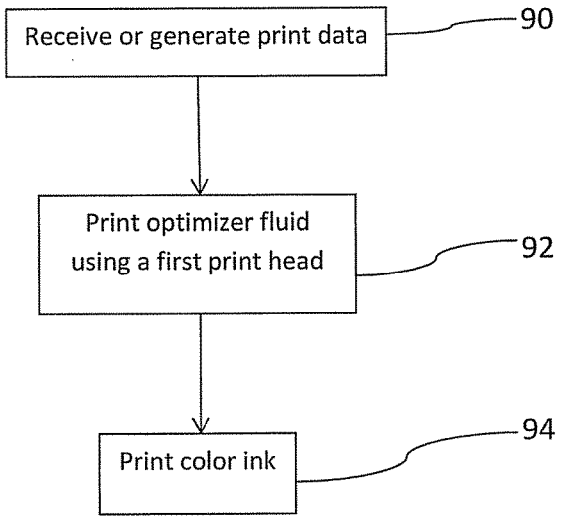
Figure 13:
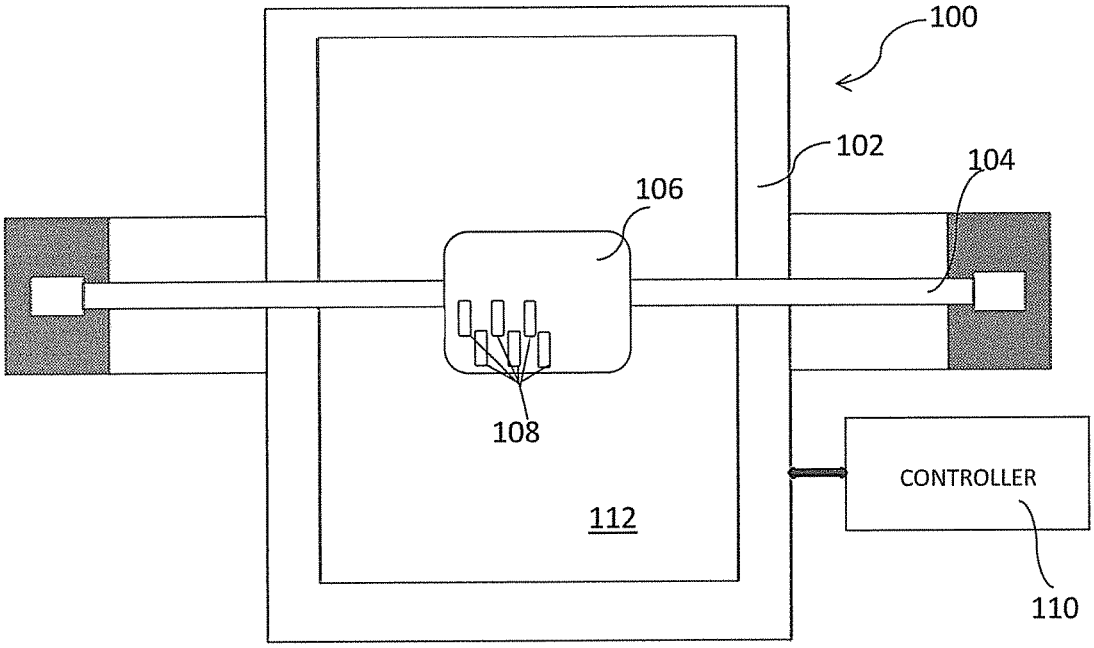

FIG. 4 schematically shows a masking scheme for one of the print heads of FIG. 2 for illustrating a method according to one example;

FIG. 5 schematically shows a masking scheme for one of the print heads of FIG. 2 for illustrating a method according to one example;

FIG. 6 schematically shows a masking scheme for one of the print heads of FIG. 2 for illustrating a method according to one example;

FIG. 7 schematically shows another masking scheme for one of the print heads of FIG. 2 for illustrating a method according to one example;

FIG. 8 schematically shows another masking scheme according to one example;

FIG. 9 schematically shows another masking scheme according to one example;

FIG. 10 shows a flow diagram of a method according to one example;

FIG. 11 shows a flow diagram of a method according to one example;

FIG. 12 shows a flow diagram of a method according to one example;

FIG. 13 shows a schematic drawing of a printer according to one example.

DESCRIPTION OF EXAMPLES

While, in the present application, a number of examples are described for illustration, this disclosure is not limited to these specific examples described and can be applied to similar devices, systems, methods and processes. The examples provided herein relate to a large format printer, e.g. an inkjet printer having a number of print heads for dispensing printing fluid. The print heads may be provided on a carriage for scanning over a print medium or may be provided in form of a page-wide printing array. In some examples, each print head contains one or several dies wherein each die is provided for the same or different colors. For example, one print head may comprise one die, the die having two nozzle trenches which provide two rows of inkjet nozzles. While the present disclosure will make reference to print heads operating with two trenches of nozzles, this disclosure is also applicable to printers having print heads operating with more than two nozzle trenches or having a number of print heads with only one nozzle trench.

Figure 1:
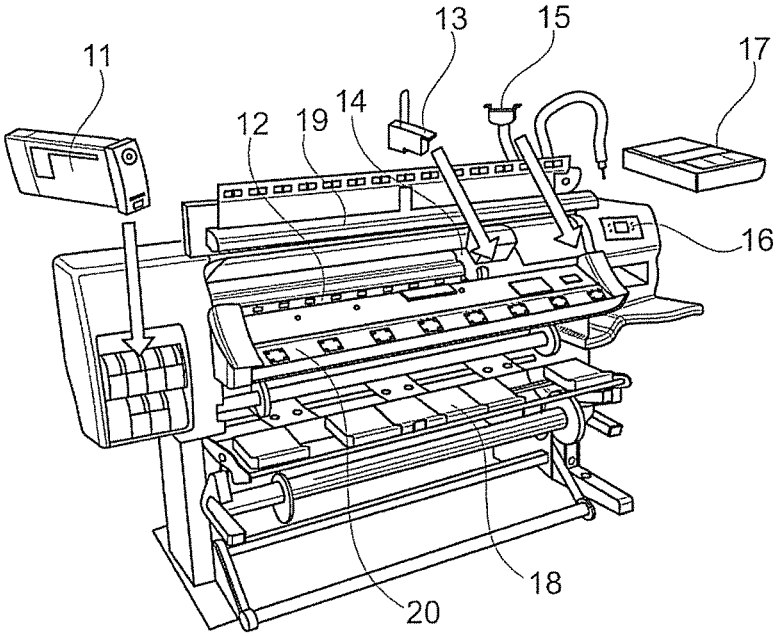
FIG. 1 shows a representation of a printer according to one example.

FIG. 1 generally shows an outline of a large format printer according one example. The printer comprises a number of ink cartridges 11, a printer platen 12, a number of print heads 13, a print head carriage 14, and ink funnel and ink tube assembly 15, a front panel 16, a print head cleaning cartridge 17, a loading table 18, a drying module 19, and a curing module 20. The printer comprises further components, such as a supporting structure, a print medium feed mechanism, motors, sensors, etc., which are not relevant for the present disclosure. The ink cartridges 11 are housed in a cartridge station. A printer controller is provided behind the front panel 16 for controlling operations of the printer. The print head carriage 14 may carry a number of print cartridges 13. One example of an arrangement of a number of print cartridges is illustrated in FIG. 2.

The print cartridge configuration shown in FIG. 2 is an example which could be used in a print head carriage providing eight cartridge slots. Five of the cartridge slots may be fitted with color ink cartridges, such as PEN1 to PEN5. Two slots may be provided with dummy cartridges or be left empty. And one slot may be provided with an optimizer fluid cartridge, such as PEN0. In the example shown in FIG. 2, each cartridge exhibits two rows of nozzle trenches wherein PEN0 is used for an optimizer fluid, with both nozzle trenches ejecting the same type of fluid. Other cartridges, PEN2 to PEN5 in this example, each provide two different color inks from the respective two trenches of nozzles. In this example, colors CMYK (cyan, magenta, yellow, black) are dispensed from two staggered nozzle trenches each, and an additional cartridge PEN1 is provided for dispensing lighter colors.

An optimizer fluid may be a fixer fluid or a binding fluid, for example, which is used in combination with certain inks, such as latex ink, to improve adherence of the ink to a print medium and avoid coalescence. An optimizer fluid more generally may be provided to improve image quality. The optimizer fluid print head PEN0 may use the same fluid for both trenches of nozzles to avoid cross contamination with other colors. Optimizer fluid, such as a fixer fluid or binding fluid, can react with the components of other color ink and it is desirable that this reaction does not occur on the surface of the print head due to aerosol or cross contamination, for example. Further, the amount of optimizer can be relatively low compared to the amount of color ink applied to a print medium, and a single print head used for the optimizer may be sufficient in a color system using two staggered print heads for CMYK colors. On the other hand, because the optimizer is printed from a single print head, instead of two staggered ones, there may occur banding effects due to this half printing swath usage. The same may happen with light color cartridge PEN1. In the example of FIG. 2, in a multi-pass printing mode, each of the print cartridges PEN2 to PEN5 could print a swath of one color having twice the width of the swath of the optimizer print cartridge PEN0 and the light color print cartridge PEN1. Because print cartridges PEN0 and PEN1 will produce only a swath of half of the width of the other print cartridges, banding effects can be provoked particularly in low pass print modes. For example, in a print mode of eight passes, a banding effect matching four passes could be created.

There are different approaches for dealing with banding effects, such as applying masks to the nozzle trenches, interleaving, weaving, pass programming selection, etc. In a multi-pass print mode, a mask is applied to the print heads during each pass so that a section or band of an image is composed by a number of pixels printed during the number of passes. In a three-pass print mode, for example, the print medium is advanced by one third of a swath height after each pass and the print heads are masked to print part of the image during each pass. Ramped masks can be used, including an up-ramp, a middle part and a down-ramp. More ink will be deposited in the middle section of the ramped mask which may lead to banding effects. Most of these masking schemes provide approaches where most of the ink is fired in only a portion of the passes and then compensated with ramps during the remaining passes. In particular, when only a low number of passes is provided, the interaction between the ink and the print medium and boundary effects due to coalescence between printed passes may have a great effect on visual banding. When the same masking strategy is used for any die and any pass, banding effects are more likely to occur.

Taking advantage of the fact that print heads operate with two or more trenches of nozzles, different strategies of uneven masking depending on the trench of nozzles used can be designed to minimize banding effects. The print mask can be different and even can be opposite over a number of passes.

The present disclosure proposes a method for printing a pattern from at least two rows of fluid ejection nozzles, said nozzles ejecting a first fluid in a multi-pass printing mode. For each pass, a mask is applied to the rows of fluid ejection nozzles for printing with selected nozzles of each row. In one example, a first mask for printing from a first row of fluid ejection nozzles during one particular pass is different from a second mask for printing from a second row of fluid ejection nozzles during said same pass. In another example, during each pass, different masks are applied to the first row of fluid ejection nozzles and to the second row of the fluid ejection nozzles. By varying the masks it is possible to manipulate the percentage of fluid deposited per pass so as to deposit gradually the total amount of fluid, e.g. of optimizer fluid.

This can be explained with reference to an example of a print head die including two trenches of nozzles ejecting the same type of fluid, such as an optimizer fluid or a particular color ink fluid. The information or pattern to be printed can be divided between the two trenches of nozzles, and each of the trenches of nozzles can follow a particular masking strategy to print the information within a desired number of passes, such as three passes, for example. In the examples of this disclosure, as indicated above, different masks are be applied to the respective trenches of nozzles during each of the three passes.

Figure 3:
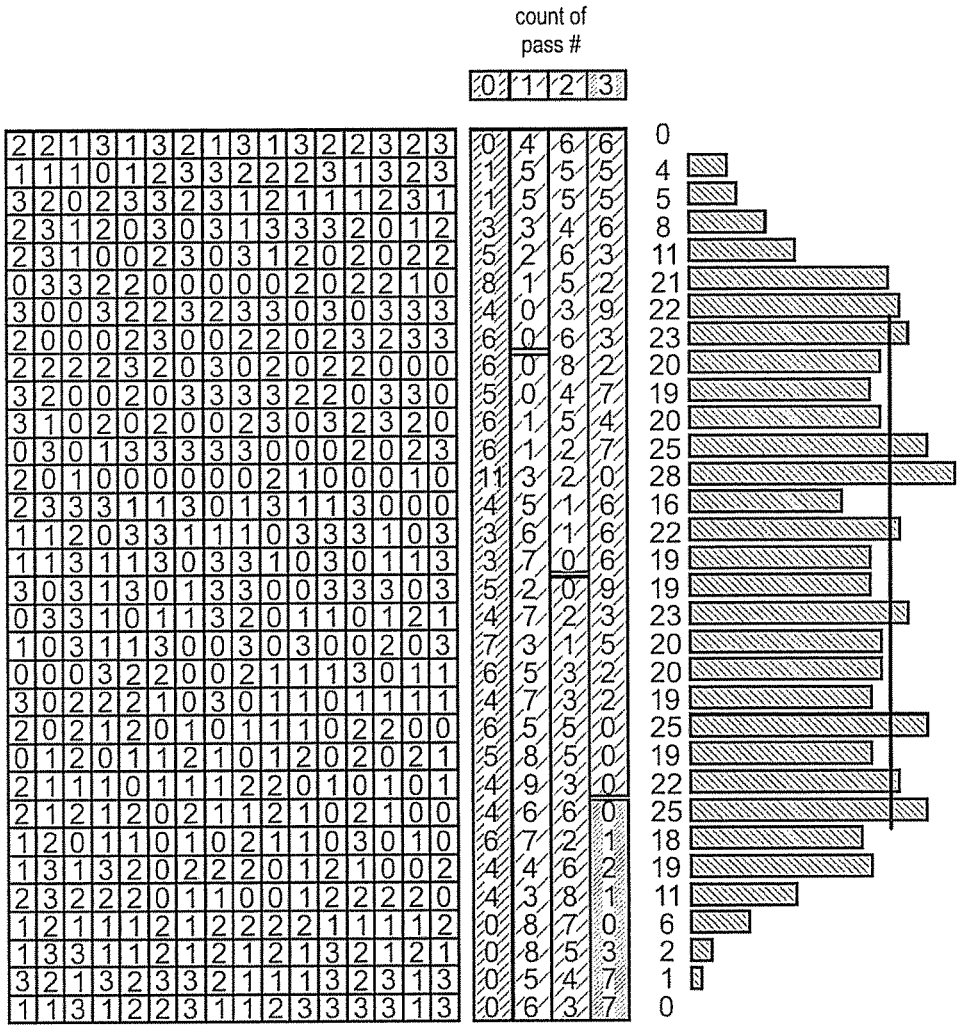
FIG. 3 illustrates how a mask can be set up, according to one example.

One example of a mask is shown in FIG. 3. This mask is an array filled with integers ranging from 0 to P-1, where P is the number of passes of the respective print mode. The mask may have the width of the number of nozzles of the printhead and may be placed over a halftoned image, so wherever a drop of ink has to be laid, the mask indicates the printhead which is fired in a respective pass. When integrating all passes, the frequencies of each nozzle of the printhead having been fired can be derived. This is known as nozzle profile. The example of FIG. 3 shows the nozzle profile (histogram) of a printhead of 32 nozzles printing a 4 passes printmode. In this example, the shape of the mask is that of one with ramps with increasing usage of the nozzles at the top of the printhead, then a constant usage, and a decreasing usage towards the end of the printhead.

Some examples of masking schemes are described with reference to FIGS. 4 to 9. These masking schemes are used on two nozzle trenches of the same printing fluid which can be provided on the same print head or on separate print heads. The two nozzle trenches can provided e.g. an optimizer fluid from an optimizer print head. Using the masking schemes described below, different masks are used per trench and per pass.

The FIGS. 4 and 5 show examples of different masks applied to two different nozzles trenches or nozzle rows during one pass. In the example of FIG. 4, a first mask M1 and a second mask M2 are illustrated schematically, wherein the first and second masks M1, M2 are applied to a first nozzles trench N1 and a second nozzle trench N2, respectively. The first mask M1 generates a nozzle profile with a highest nozzle frequency at a first end of the nozzle trench and a lowest frequency (possibly zero) at the opposite (second) end of the nozzle trench. The second mask M2 provides a nozzle profile which is just opposite to the first mask M1, with a lowest nozzle frequency at the first end of the second nozzle trench and highest frequency at the opposite (second) end of the nozzle trench.

The example of FIG. 5 also shows the use of two masks M1, M2 which are applied to first and second nozzle trenches N1, N2, wherein mask M1 is an inverted version of mask M2, namely a ramped mask M2, similar to the one shown in FIG. 3, and an inverted ramped mask M1 in which the frequencies for each nozzle are opposite to that of mask M1. In other words, when the mask M2 generates a low nozzle frequency, mask M1 generates a high nozzle frequency and vice versa.

The masking scheme described herein can be applied to an optimizer fluid (binding fluid, fixer fluid, etc.) because this is commonly a transparent fluid, and the masking scheme can be used for controlling the density of the fluid applied to the print medium. By manipulating the masks (nozzles firing less or more frequently) compared to using equal standard masks, it is possible to increase or decrease the density. By splitting the firing of nozzles between two trenches and selecting different densities per pass, per trench, an optimum density can be achieved. Just as an example, considering the use of optimizer ink, to have proper image quality attributes, it would be sufficient to deposit less than 1 drop of ink per some number X of pixels on average; this density can be adjusted using the masking scheme disclosed herein.

FIG. 6 illustrates another example of a masking scheme and schematically shows an example of a print head die 30, including two trenches or rows of nozzles 32, 34. The print head die 30 may be part of an optimizer fluid print head, such as PEN0 shown in FIG. 2 but also may be the print head die of another print cartridge. In the example of FIG. 6, a three-pass printing mode is selected. During a first pass, the nozzles of nozzle trench 32 are masked using mask A, and the nozzles of nozzle trench 34 are masked using mask a; during a second pass, the nozzles of nozzle trench 32 are masked using mask B, and the nozzles of nozzle trench 34 are masked using mask b; and during a third pass, the nozzles of nozzle trench 32 are masked using mask C, and the nozzles of trench 34 are masked using mask c. In this example, masks A and c deposit about 100% of the total fluid to be fired during that pass, masks B and b deposit about 50% of the total fluid and masks C and a deposit 0% of the fluid. The sum of fluid fired from both trenches during one pass will be 100% but these 100% is split between two (or more) trenches. The masks are configured to have ramps and are applied to the rows or trenches of nozzles 32, 34 in such a way that, considering the overlap of nozzles in each pass, the same amount of fluid can be applied to the print medium within one swath. The resulting mask overlap is shown at the right hand side of FIG. 6. In the illustration of FIG. 6, it is shown how each of the nozzle trenches 32, 34 is associated with a series of mask and it is also indicated which nozzles are activated how many times during each individual pass. Series 1, 2 and 3 in the bottom diagrams of FIG. 3 refer to the first, second and third pass of a swath. The upper diagram shows that zero nozzles of trench 32 are activated in the third pass (Series 3, corresponding to mask C) and the lower diagram shows that zero nozzles of trench 34 are activated in the first pass (Series 1, corresponding to mask a). In the two plots shown in FIG. 6 (and FIG. 7 described below), the "X" axis represents the nozzle number (in this example, one nozzle trench comprises 1056 nozzles) and the "Y" axis represents the number of times each nozzle is fired in a mask of 256 columns at 600 dpi. Of course, the parameters of this specific example serve as an example only.

It has been found that the use of different masks for the two nozzle trenches 32, 34 in each pass provides better results in banding with the same amount of fluid being deposited. In the example described with reference to FIG. 3, the total amount of fluid ejected from the two rows of fluid ejection nozzles is the same or about the same during each pass, but different amounts of fluid are respectively ejected from the first and second trenches during a single pass. It may be that this masking scheme helps to keep the print head temperature low so that temperature fluctuations may have less of an influence on the generation of droplets and there will be less drop weight variation between beginning and ending of a swath. If the print head, to which the masking scheme described herein is applied, is an optimizer fluid print head, optimizer can be deposited before, after or subsequently with the printing color ink, the deposited optimizer fluid being more evenly distributed over the print medium so as to avoid or reduce banding and, more generally, optimizing the image quality. Similar advantages can be achieved when printing with a single print head for one particular color.

In the example described, in three subsequent passes, three different masks are applied. In other examples, in n passes, a sequence of n masks can be applied to a first row of fluid ejection nozzles and another sequence of n masks can be applied to the second row of fluid ejection nozzles. The other sequence of n masks may be just opposite to the sequence of masks applied to the first row of fluid ejection nozzles. A sequence of n masks may be provided such that the first mask deposits a largest percentage of fluid and a last mask deposits a smallest percentage of fluid, without limiting this disclosure to any particular sequence of masks.

FIG. 7 schematically shows another example of a sequence of masks for a three-pass printing mode. The sequence of masks can be applied to the same type of print head as the mask illustrated in FIG. 6. During a first pass, the nozzles of nozzle trench 32 are masked using mask D, and the nozzles of nozzle trench 34 are masked using mask d; during a second pass, the nozzles of nozzle trench 32 are masked using mask E, and the nozzles of nozzle trench 34 are masked using mask e; and during a third pass, the nozzles of nozzle trench 32 are masked using mask F, and the nozzles of nozzle trench 34 are masked using mask f. In this example, mask D, E, F are ramped masks wherein, during each pass, the number of nozzles activated are ramped-up, held at a constant level, and ramped-down. The masks d, e, f each are ramped masks which are the inverse of masks D, E, F The two graphs on the bottom on FIG. 7 illustrate which nozzles are activated how many times during each individual pass, as determined by mask D, E, F, d, e and f wherein Series 1, 2 and 3 refer to the first, second and third pass of a swath.

The configuration of this example allows square masks to be achieved by using inverse ramped masks on the two nozzle trenches, instead of using square masks in both nozzle trenches. This configuration further allows better control on boundary banding than a masking scheme which directly applies square masks to each nozzle trench as this approach achieves a smoother transition. This is illustrated on the right-hand side of FIG. 7.

Other combinations of masks are possible, including combinations of the above approaches and further including variable density and/or position of the masks within the print head. Two further examples of sequences of masks for a three-pass print mode are illustrated in FIG. 8 and FIG. 9.

The masking approach shown in FIG. 8 combines the masking scheme of FIG. 7 with an offset.

The masking approach of FIG. 9 is similar to that of FIG. 6, except that, for the first trench, a first mask deposits about 75% of the fluid, a second mask deposits about 50% of the fluid and a third mask deposits about 25% of the fluid, with the masking scheme for the second trench being inverted.

FIG. 10 shows a flow diagram of a method according to one example. The example shown in FIG. 10 starts with receiving print data, at 70, wherein print data can be received from any source, such as a host computer, server, a peripheral device, of from a remote source via the Internet or an intranet, without any limitation. The print data may be received by a printer controller within a printer or external to the printer for processing data to be printed. The print data defines a pattern or image to be printed. This pattern or image to be printed is divided between at least two rows of fluid ejection nozzles, at 72. In the example described, any pattern or image to be printed will be printed in predetermined number of passes per swath. After the pattern has been divided between the rows of fluid ejection nozzles of one or more print heads, a first mask is applied to a first row of fluid ejection nozzles and a second mask is applied to a second row of fluid ejection nozzles, at 74. Within one pass, different masks will be applied to different rows of fluid ejection nozzles. Based on the pattern portion attributed to each row of nozzles and the associated mask, one pass is printed with said masked first and second rows of fluid ejection nozzles, at 76. As indicated above, during each pass, a mask applied to a first row of fluid ejection nozzles is different from a mask applied to a second row of fluid ejection nozzles. Nevertheless, the total amount of fluid ejected from the at least two rows of fluid ejection nozzles may be the same or about the same during each pass.

FIG. 11 shows a flow diagram of a method according to another example. The example starts with receiving or generating print control data for multiple swaths to be printed, at 80. Control data can be received or generated by a printer controller or an external device, as described above.

One swath shall be printed using at least two rows of fluid ejection nozzles which can be provided on one or more print heads. The swath is divided between the at least two rows of fluid ejection nozzles, at 81. The swath shall be printed in N passes and the N pass printing process starts at 82 for a current swath, setting a counter to n=0. For printing the first pass of a swath, a first mask is applied to a first row of fluid ejection nozzles and a second mask is applied to a second row of fluid ejection nozzles. The designations "n1" and "n2" in FIG. 8 refers to the n-th swath of the first and second row of fluid ejection nozzles, respectively. Mask (n1) is unequal to Mask (n2). A first pass is printed using said print data and masks, at 84.

Subsequently, the counter is increased by one, n=n+1, at 85. Next it is checked, at 86, whether a predefined number N of passes has been printed, n=N?. If no, a next set of first and second masks, mask (n1) and mask (n2), are applied to the first and second rows of fluid ejection nozzles, at 83. The next pass is printed, at 84, and the counter is incremented by one, at 85.

If the total number of passes of one swath has been printed, block 87 checks whether all swaths have been printed. If no, the method returns to block 80 for generating or receiving print control data for the next swath. Block 89 prompts the method to process the next swath.

Once all swaths have been printed, printing is completed, at 88.

While different masks are applied to the first and second rows of fluid ejection nozzles during one pass, it is possible to use a sequence of masks and inverted versions of said sequence of masks on the two rows of fluid ejection nozzles, for example. Further, the two masks applied to the two rows of fluid ejection nozzles during one pass can be such that the total amount of fluid ejected remains the same or about the same.

FIG. 12 shows again a flow diagram of a method according to one example, which may be used in combination with the methods depicted in one of FIG. 10 or 11. Referring to FIG. 12, as in FIGS. 10 and 11, print data are received or generated, at 90. Based on this print data, optimizer fluid is printed using a first print head, as shown in block 92. The optimizer fluid may be printed by applying a process as shown in one of FIGS. 10 and 11. After the optimizer fluid has been deposited on a print medium, an image is printed using color ink print heads, as shown in block 94. In this example the optimizer is deposited before printing color ink. This may help improving adherence of the color ink to a print medium and avoiding coalescence or, more generally, improving image quality. Depending on attributes of the printing process, such as type of print medium and ink, the optimizer fluid may be deposited after or subsequently with printing color ink. Using the method of this disclosure for depositing the optimizer ink helps to manipulate the percentage of fluid fired per pass so as to deposit gradually the total amount of fluid, e.g. an optimizer fluid.

FIG. 13 shows a very schematic drawing of a printer, according to one example. The printer 100 comprises a frame 102, a scan axis bar 104, and a print head carriage 106. The carriage carries a number of print heads 108, each print head including a number of nozzle trenches. At least the first one of said print heads 108 ejects a first type of printing fluid, such as an optimizer fluid (such as binding fluid, fixer fluid, etc.). In this example, the remaining print heads 108 may eject a color ink, e.g. a latex ink. These further print heads 108 can be arranged such that two nozzle trenches of a print head respectively eject ink of different colors. The printer 100 further comprises a printer controller 110 including a control program for controlling ejection of printing fluid from the print heads 108 and applying masks to at least two nozzle trenches for printing with selected nozzles of each nozzle trench during different passes of a multi-pass print mode. The control program may be implemented in software or firmware or combinations thereof. It may be resident partly or completely within the printer controller and it also may be provided by or interact with an external control device. FIG. 13 further schematically shows a print medium 112 below the carriage 106. As explained above, a first mask for printing from a first nozzle trench during one particular pass is different from a second mask for printing from a second nozzle trench during said pass.

The invention claimed is:

1. A method of printing a pattern from at least two rows of fluid ejection nozzles, said nozzles ejecting a first fluid in a multi-pass printing mode, the method comprising:

dividing the pattern to be printed between the rows of fluid ejection nozzles;

applying masks to the rows of fluid ejection nozzles for printing with selected nozzles of each of the rows of fluid ejection nozzles during each pass; and printing, over multiple passes, with the selected nozzles of each of the rows of fluid ejection nozzles to which the masks have been applied, wherein a first mask for printing from a first row of fluid ejection nozzles during an n-th pass is different from a second mask for printing from a second row of fluid ejection nozzles during said n-th pass, and wherein, in N passes, a sequence of N masks including the first and second masks is applied to the first row and an inverse sequence of the N masks is applied to the second row.

2. The method of claim 1, wherein, during each pass, a mask applied to the first row of fluid ejection nozzles is different from a mask applied to the second row of fluid ejection nozzles.

3. The method of claim 1, wherein, during each pass, the total amount of fluid ejected from the at least two rows of the fluid ejection nozzles is the same.

4. The method of claim 3, wherein, within the sequence of N masks, a first mask activates a highest number of nozzles and a last mask activates a lowest number of nozzles.

5. The method of claim 1, wherein said masks comprise ramps.

6. The method of claim 1, wherein said nozzles eject an optimizer fluid.

7. The method of claim 1, wherein the at least two rows of fluid ejection nozzles are provided on one print head.

8. A printer comprising:

a number of print heads having a number of nozzle trenches, the nozzles of at least two nozzle trenches to eject a first type of printing fluid; and a printer controller including a control program to control ejection of printing fluid from the print heads, and applying masks to the at least two nozzle trenches to print with selected nozzles of each nozzle trench during different passes of a multi-pass printing mode, wherein a first mask to print from a first nozzle trench during an n-th pass is different from a second mask to print from a second nozzle trench during said n-th pass, and wherein, in N passes, a sequence of N masks including the first and second masks is applied to the first row and an inverse sequence of the N masks is applied to the second row.

9. The printer according to claim 8 wherein said number of print heads comprises:

a first print head including said at least two nozzle trenches to eject said first type of printing fluid, and a set of further print heads, each further print head including at least two nozzle trenches to eject a second type of printing fluid, wherein said first type of printing fluid is an optimizer fluid and said second type of printing fluid is an ink.

10. The printer according to claim 9, wherein said second type of printing fluid is a latex ink.

11. The printer according to claim 9, wherein the at least two nozzle trenches of each of the further print heads respectively are to eject ink of a different color.

12. The printer according to claim 9, wherein the set of further print head comprises four print heads, each print head including two nozzle trenches.

13. A method of printing a pattern in a large format printer, the printer including a first print head including two rows of fluid ejection nozzles ejecting an optimizer fluid, and a set of second print heads, each second print head including two rows of fluid ejection nozzles ejecting color ink, the two rows including a first row and a second row, the method comprising:

in a multi-pass printing mode, depositing the optimizer fluid during a number of passes, wherein a different mask is applied to each of the two rows of fluid ejection nozzles of the first print head during a respective pass; and depositing color ink during a number of passes from the set of second print heads, after the optimizer fluid has been deposited, wherein, during each pass, the total amount of fluid ejected from the at least two rows of the fluid ejection nozzles is the same, and wherein, in N passes, a sequence of N masks is applied to the first row and an inverse sequence of the N masks is applied to the second row.

14. The method of claim 13, wherein, during each pass, the total amount of optimizer fluid deposited is the same.

* * * * *